US009462875B2

(12) United States Patent
Paduano et al.

(10) Patent No.: US 9,462,875 B2
(45) Date of Patent: Oct. 11, 2016

(54) BACKPACK WITH ADJUSTABLE HIP-BELTS

(71) Applicant: The North Face Apparel Corp., Wilmington (DE)

(72) Inventors: Matthew Edward Paduano, Oakland, CA (US); Christopher Kenji Tagumi, Oakland, CA (US); Sky Blue Sterry, Bozeman, MO (US); Patricia Jean Wookey, Bozeman, MO (US)

(73) Assignee: THE NORTH FACE APPAREL CORP., Wilmington, DE (US)

( * ) Notice: Subject to any disclaimer, the term of this patent is extended or adjusted under 35 U.S.C. 154(b) by 0 days.

(21) Appl. No.: 13/792,958

(22) Filed: Mar. 11, 2013

(65) Prior Publication Data

US 2014/0252059 A1 Sep. 11, 2014

(51) Int. Cl.
*A45F 3/04* (2006.01)

(52) U.S. Cl.
CPC ..... *A45F 3/047* (2013.01); *A45F 2003/045* (2013.01)

(58) Field of Classification Search
CPC ..... A45F 3/04; A45F 3/08; A45C 1/04; A61F 5/00
USPC ..... 224/262, 631, 632, 635, 637, 641, 663
See application file for complete search history.

(56) References Cited

U.S. PATENT DOCUMENTS

| | | | | |
|---|---|---|---|---|
| 4,013,201 | A | 3/1977 | Potter | |
| 4,015,759 | A | 4/1977 | Dreissigacker et al. | |
| 4,964,860 | A | 10/1990 | Gipson et al. | |
| 5,131,576 | A * | 7/1992 | Turnipseed | 224/262 |
| 5,432,951 | A | 7/1995 | Yewer, Jr. | |
| 5,725,139 | A | 3/1998 | Smith | |
| 5,762,251 | A | 6/1998 | Gleason | |
| 6,202,907 | B1 | 3/2001 | Higgins | |
| 6,536,641 | B1 | 3/2003 | Sundara et al. | |
| 6,609,642 | B2 | 8/2003 | Heinz et al. | |
| 6,626,342 | B1 | 9/2003 | Gleason | |
| 6,651,853 | B2 | 11/2003 | Higgins et al. | |
| 6,802,442 | B1 * | 10/2004 | Thompson | 224/637 |
| 7,021,508 | B1 | 4/2006 | Aston | |
| 7,028,873 | B1 | 4/2006 | Collier et al. | |
| 7,673,777 | B2 | 3/2010 | Gleason, Jr. | |
| 2003/0054296 | A1 | 3/2003 | Howell | |
| 2006/0163305 | A1 | 7/2006 | Tong | |
| 2012/0018479 | A1 * | 1/2012 | Thibadeau, Jr. | A45F 3/047 224/637 |

* cited by examiner

*Primary Examiner* — Corey Skurdal
(74) *Attorney, Agent, or Firm* — Kenyon & Kenyon LLP

(57) ABSTRACT

A backpack with an adjustable hip-belt set may include a backpanel, which may further include a panel sheet, a set of metal stays, and a thoracic carriage. The metal stays may be supported by a frame. Certain embodiments also include an adjustment mechanism, which may have hip-belt straps marked with indicia of measurement. A user may adjust the size of the hip-belt set by moving the straps horizontally in and out of cam buckles and by fastening the straps once a desired length is achieved.

19 Claims, 4 Drawing Sheets

BACKPACK WITH ADJUSTABLE HIP-BELTS

TECHNICAL FIELD

The present invention generally relates to backpacks, which can be used for travelling, or in a wide range of outdoor activities, such as hiking, camping, fishing, and the like.

BACKGROUND

Distribution of the weight of a backpack across several muscle groups reduces strain on the body of the user, which in turn decreases fatigue and enhances safety. Increasing the surface area of the contact between shoulder straps and the body by attaching padding to the shoulder straps decreases pressure at the pressure points on the user's body, thereby enhancing comfort and preventing injuries. An additional option for distributing weight of the backpack is implementation of hip-belts, which share the weight of the load with shoulder pads.

Versatility remains a key aspect for backpack design, and an ideally designed product can be used by individuals of widely varying heights, weights, and overall body type. Obtaining an optimal fit to the body of an individual user is an important consideration for hip-belts as well. Any deviation from an optimal fit diminishes both the safety and the comfort of hip-belts, and, consequently, of the backpack of which they are a part.

Conventional hip-belt adjustment systems attempt to address this issue by employing hook-and-loop panels, such as Velcro™. These systems, however, require the user to remove the entire hip-belt from the pack in order to readjust it to fit a user. This requires the user to remove the pack, detach the hook-and-loop, adjust the size of the belt accordingly, center the hip-belt system back onto the frame, and fasten it in place.

These systems have several drawbacks. First, these systems inject a large degree of approximation (i.e. inaccuracy) in each hip-belt adjustment. Because the attachment of hook-and-loop elements entails pressing one surface against another, there is a potential to position one end higher or lower than intended, or to place the belt off-center each time the adjustment is made. This "guess work" hinders the fit between the hip-belts and the user's body, thus diminishing the weight distribution. Second, the process of placing the hip-belts on and taking them off the backpack frame is cumbersome, tedious, and significantly inconvenient to the user.

Accordingly, there is a need for a backpack which features hip-belts that can be accurately, securely, and easily customized to the body of a user.

SUMMARY

One aspect of the present invention relates to backpacks that incorporate hip-belts for improved weight distribution of the load. One example of such an apparatus may include an adjustable padded shoulder-strap set, where the shoulder-strap set may be attached to a backpanel, and an adjustable padded hip-belt set, where the hip-belt set may be attached to the backpanel by a hip-belt adjustment mechanism. The hip-belt adjustment mechanism further may comprise at least one hip-belt strap, where the adjustable hip-belt set may be configured to be adjusted by moving the hip-belt strap horizontally. The hip-belt strap may be fastened in place by a cam buckle, and a marker may be affixed to the backpanel to function as a reference for a plurality of indicia of measurement. Moreover, the plurality of indicia of measurement may be formed by stitching and may be equidistant with respect to each other.

One embodiment may include a lumbar pad, wherein the lumbar pad may be attached to the backpanel and placed over the hip-belt adjustment mechanism. The lumbar pad may either be fully or partially detachable from the backpanel, and detaching the lumbar pad from the backpanel may provide access to the hip-belt adjustment mechanism.

Another embodiment may include a ruler belt, wherein setting a length of the ruler belt may adjust a thoracic height of the backpanel. The ruler belt may include a plurality of indicia of measurement, which may be formed by etching. The ruler belt may further include a length indicator, wherein the length indicator may be affixed to the backpanel to function as a reference for the plurality of indicia of measurement.

In one example, the backpanel may contain a panel sheet and a thoracic carriage, wherein the thoracic carriage moves strictly in the vertical direction, or moves exclusively as one unit, or both.

Another aspect of the present invention relates to a method of customizing hip-belts, which may include: passing a hip-belt strap through a reference marker, where the reference marker may be affixed to a backpanel, threading the hip-belt strap through a cam buckle, where the cam buckle may be affixed to the backpanel, moving the hip-belt strap in the horizontal direction in order to adjust a length of the hip-belts, using the cam buckle to fasten the hip-belt strap in place, and marking the adjusted length of the hip-belts by a plurality of indicia of measurement in reference to the marker. This method may further include removing a fully or partially detachable lumbar pad in order to access a hip-belt adjustment mechanism.

BRIEF DESCRIPTION OF THE DRAWINGS

The present invention will become more fully understood from the detailed description given below and from the accompanying drawings. The drawings are intended to disclose but a few possible examples of the present invention, and thus do not limit the present invention's scope.

DETAILED DESCRIPTION

The present invention generally relates to backpacks and more particularly to those having adjustable hip-belts. While a preferred example of a backpack is described in detail below, the adjustable hip-belt system described herein may also be applied to a broad variety of packs, including external frame backpacks and rucksacks.

Figure 1:
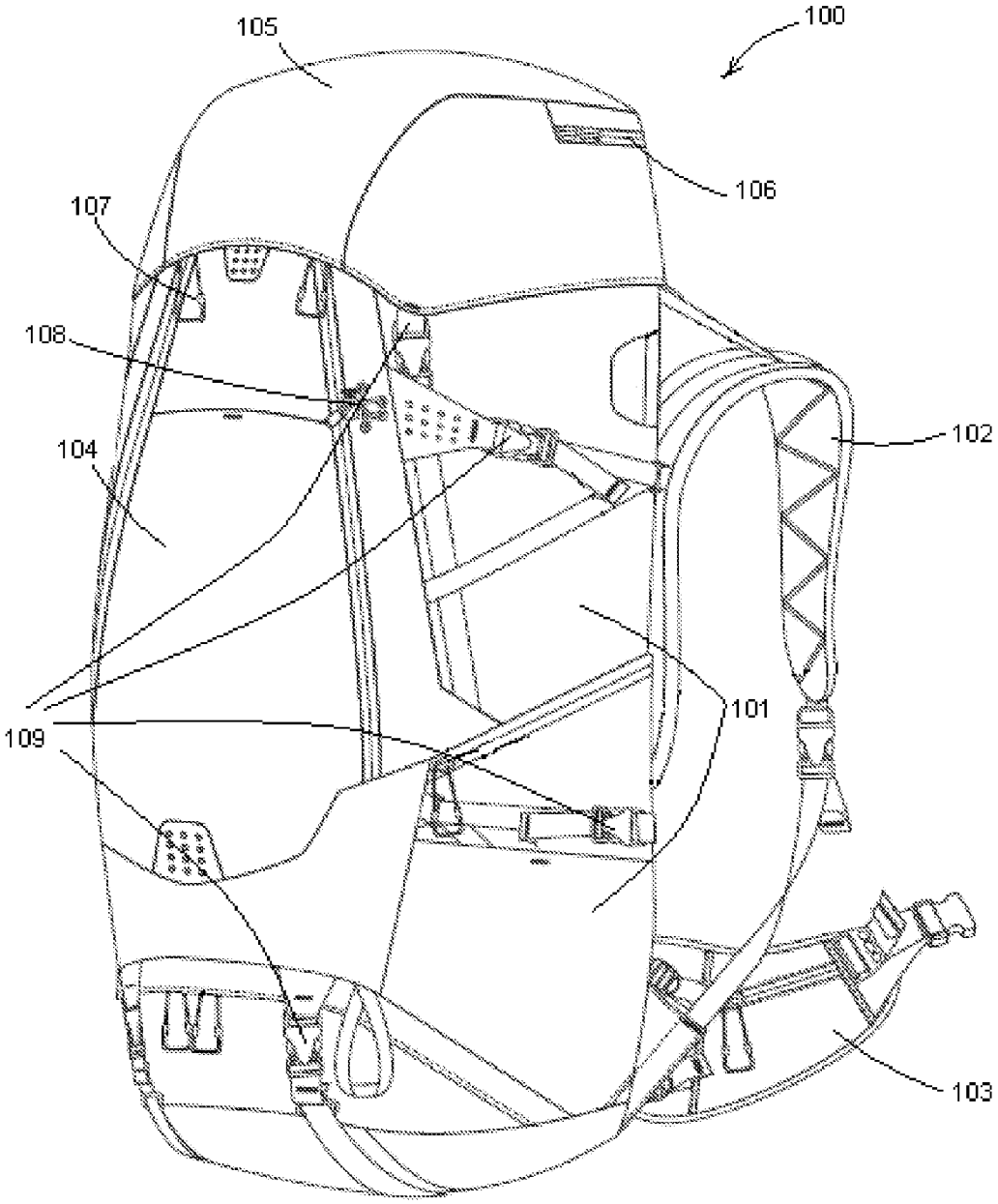
FIG. 1 shows an example of a backpack with adjustable hip-belts in accordance with certain embodiments of the present invention.

One example of a backpack in accordance with the present invention is shown in FIG. 1. A backpack 100 includes a front load-containing portion 101, a backpanel (not shown in this view) adjacent to the load-containing portion 101, a shoulder-strap set 102 attached to the backpanel, and a hip-belt set 103, also attached to the backpanel. The load-containing portion 101 may include a main load storage portion 104 and a top storage portion 105, wherein the top storage portion 105 may be fully detachable from the main load storage portion 104.

Both storage portions 104 and 105 may vary in color and may be constructed substantially of nylon, or any other material deemed appropriate. Further, both storage portions 104 and 105 may include at least one external pocket 106, which may be opened and closed by a zipper mechanism 107. Contents of the backpack 100 may be securely fastened and immobilized within the load containing portion 101 by compression straps 109 in order to adjust the shape and the depth of the load containing portion 101. Further, cording 108 may be used for holding tools, for example, and it may be made of either elastic or static material, or any other material deemed suitable for carrying tools.

Figure 2:
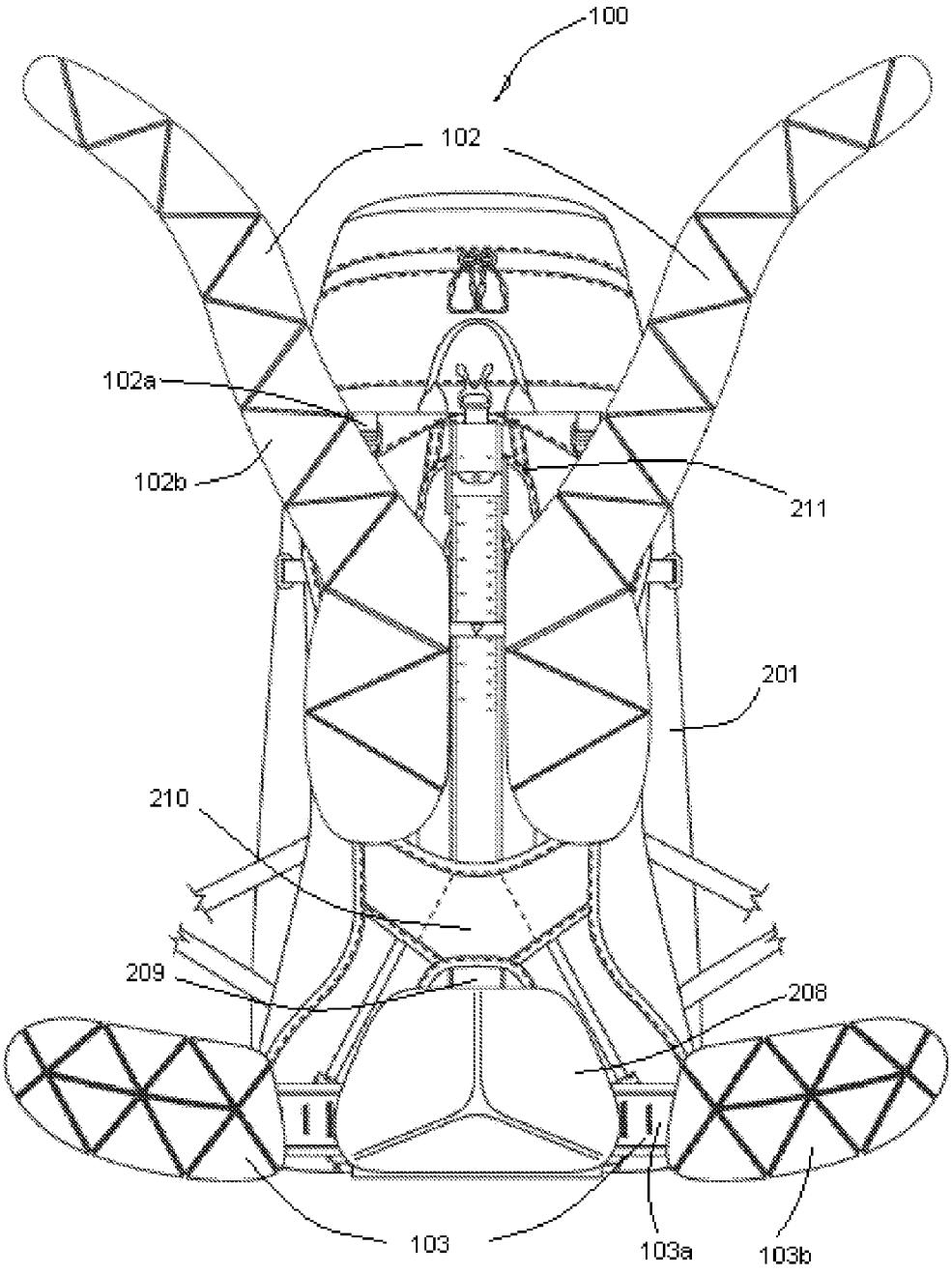
FIG. 2 shows an example of a backpanel with shoulder pads, hip-belt pads, and a lumbar pad attached to the backpanel, in accordance with certain embodiments of the present invention.

Turning to the back view of one of the embodiments, FIG. 2 illustrates a backpanel 201 of backpack 100, to which the shoulder-strap set 102 and the hip-belt set 103 may be attached. The hip-belt set 103 is attached to the backpanel 201 by a hip-belt adjustment mechanism (not shown in this view), which may constitute means for adjusting size of the hip-belt set 103 in order for it to be customized to a user.

The shoulder-strap set 102 may include adjustable shoulder straps 102*a* and shoulder pads 102*b*. One function of the adjustable shoulder straps 102*a* is to carry a portion of the load of the backpack 100. One function of the shoulder pads 102*b* is to increase the area surface of the contact between the shoulder straps 102*a* and the shoulders of the user, in order to decrease the pressure at the pressure points on the user's body, thereby enhancing comfort level and preventing injuries. Both shoulder straps 102*a* and the outer side of shoulder pads 102*b* (not shown) may be constructed substantially of nylon, or any other suitable material. Non-limiting examples of suitable material for the inner (i.e. user's shoulder) side of shoulder pads 102*b* include ethylene vinyl acetate (EVA).

The hip-belt set 103 may be adjustable and it may include two hip-belt straps 103*a* and two hip-belt pads 103*b*. One function of the hip-belt straps 103*a* may be to carry a portion of the load of the backpack 100. The adjustable hip-belt set 103 may be configured to be adjusted by moving the hip-belt straps 103*a* horizontally. One function of the hip-belt pads 103*b*, similarly to the shoulder pads 102*b*, may be to increase the area surface of the contact between the hip-belt pads 103*b* and the body of the user, in order to decrease pressure at pressure points on the user's hip and lumbar areas, thereby enhancing comfort and preventing injuries. Both the hip-belt straps 103*a* and the outer (not shown) side of the hip-belt pads 103*b* may be constructed substantially of nylon, or any other suitable material. Non-limiting examples of suitable material for the inner (user's hip area) side of the hip-belt pads 103*b* include ethylene vinyl acetate (EVA).

As shown in FIG. 2, the backpanel 201 may further include a lumbar pad 208, which may have a similar cushioning function as the shoulder pads 102*b* and the hip-belt pads 103*b*, and it may be constructed of the same or similar material. In one of the embodiments, the lumbar pad 208 may be placed over the hip-belt adjustment mechanism. The lumbar pad 208 may attach to the backpanel 201 in two places, and may be either fully or partially detachable from the backpanel 201. In one embodiment, a hook-and-loop sheet insert 209, which may be permanently affixed to the lumbar pad 208, may be slid underneath external fabric 210 of the backpanel 201. Thus, by unhooking the sheet insert 209 from underneath the external fabric 210, the upper end of the lumbar pad 208 may be lowered. Thereby, the lumbar pad 208 may be partially detached from the backpanel 201 in order to provide access to the hip-belt adjustment mechanism, as shown in FIG. 3.

A thoracic carriage 211 may be configured or adapted to only move in the vertical direction, i.e. to be restrained from moving on a horizontal or angled axis. This guides the movement of the user's back in the vertical direction and is intended as an injury prevention feature. In addition, the thoracic carriage 211 may be configured or adapted to move exclusively as one unit, i.e. without allowing the two symmetrical sides of the carriage 211 to move independently.

Figure 3:
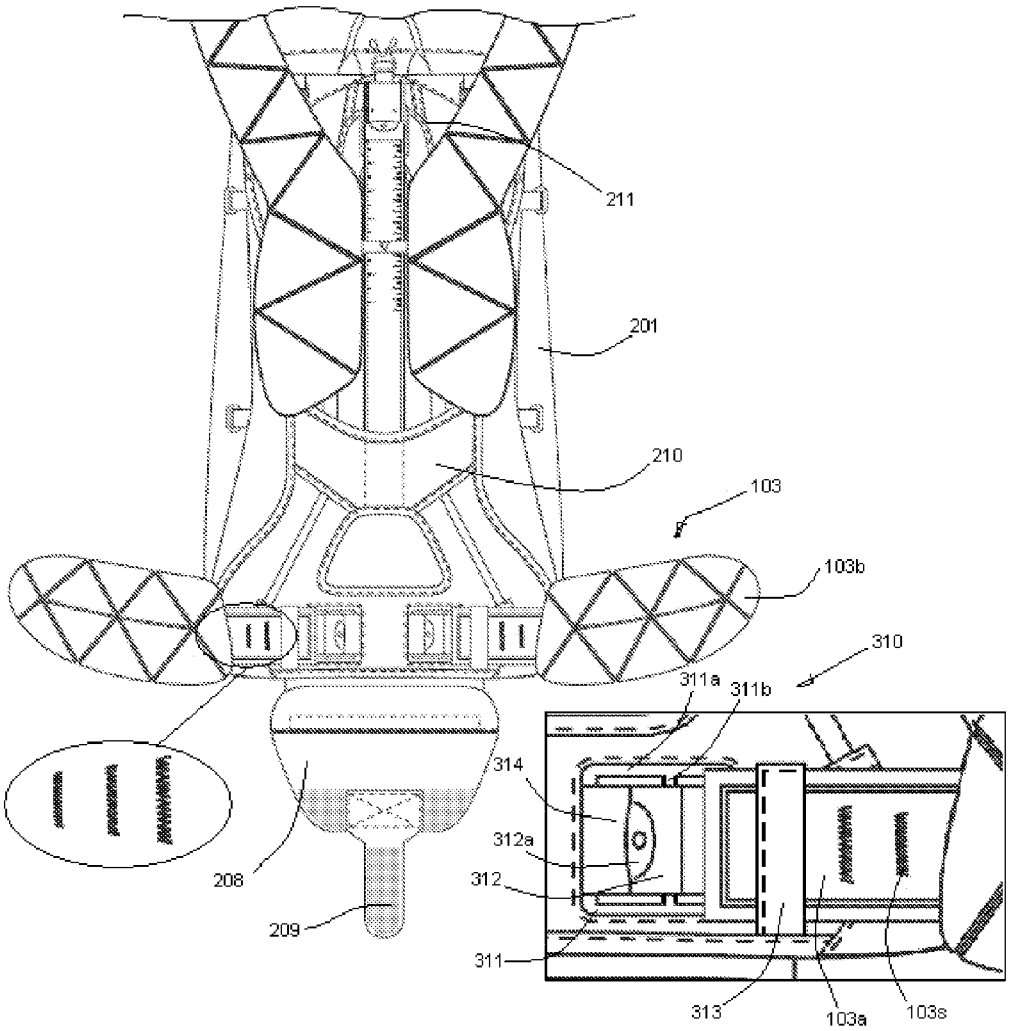
FIG. 3 shows an example of a backpanel with a lumbar pad lowered, in order to provide access to a hip-belt adjustment mechanism, in accordance with certain embodiments of the present invention.

FIG. 3 illustrates a back view of one embodiment, with the lumbar pad 208 lowered and the hip-belt adjustment mechanism 310 exposed (shown enlarged in FIG. 3). The hip-belt adjustment mechanism 310 may include cam buckle 311, cam lock 312, hip-belt strap 103*a*, marker 313, and buckle webbings 314. In one embodiment, the marker 313 may constitute a webbing piece. The buckle webbings 314 may be used to mount the cam buckle 311 to the backpanel 201. The cam buckle 311 may include cam buckle frame 311*a* and cam buckle shaft 311*b*. The cam lock 312 may include convex portion 312*a*. The hip-belt strap 103*a* may include a plurality of indicia of measurement 103*s*. In one example, the indicia of measurement 103*s* may be formed by stitching, and they may be equidistant with respect to each other. Every subsequent indicia of measurement 103*s* may decrease in length, as shown enlarged in FIG. 3. The cam buckle 311, and the cam lock 312 may be constructed substantially of acetal, or any other material considered suitable for the function performed by these two elements, discussed below. Non-limiting examples of suitable material for the marker 313 and buckle webbings 314 include nylon.

The hip-belt set 103 may be attached to the backpanel 201 by using the hip-belt straps 103*a*. The hip-belt straps 103*a* may be threaded through the cam buckles 311, and may further be looped around the cam buckle shafts 311*b*. The hip-belt straps 103*a* may further slide through the cam buckles 311 and over the cam buckle shafts 311*b*. The cam locks 312 may rotate around the cam buckle shafts 311*b* and flap between at least two distinct positions: an open position and a closed position, the latter illustrated in FIG. 3. In one embodiment, the cam lock 312 includes a ridge and the cam buckle frame 311*a* includes a groove matching the ridge of the corresponding cam lock 312. The cam lock 312 may snap into the closed position by applying mechanical force on the lock 312 in order to fit the ridge into the groove.

Upon threading and looping the hip-belt strap 103*a* through the cam buckle 312, the length of the strap 103*a* may be adjusted in a horizontal direction. Such adjustment depends on the shape and dimensions, as well as preferences of the user. The length of the hip-belt strap 103*a* may be adjusted without removing the hip-belt set 103 from the backpanel 201. This may be achieved in the following manner: the cam lock 312 is loosened by pulling on the convex portion 312*a*. Next, the hip-belt strap 103*a* is either slid in or pulled out of the cam buckle 311. Once the user is satisfied with the fit of the hip-belts against his/her hips and lumbar area, the cam lock 312 may snap in place and restrain the hip-belt strap 103*a* from further sliding, i.e. the cam buckle 311 may fasten the strap 103*a* in place.

In one embodiment, the marker 313 may be placed near each cam buckle 311 on the side closer to the hip-belt pad 103*b*. Further, the marker 313 may be channeled, in order for the hip-belt strap 103*a* to be passed through it.

Moreover, the indicia of measurement 103*s* may be used as visual indicators. Namely, as the hip-belt strap 103*a* length changes, i.e. as the strap 103*a* slides in and out of the cam buckle 311, the indicia of measurement 103*s* may move horizontally relative to both the cam buckle 311 and the marker 313, which may be fixed. Thereby, the marker 313 may function as a reference for the indicia of measurement 103*s*, and their relative positions may, consequently, mark the exact length to which the hip-belt strap 103*a* has been set.

This embodiment of the present invention increases both accuracy and efficiency of the hip-belt strap 103*a* length adjustment by substantially simplifying the process of customizing a backpack to an individual user. Namely, once the user selects his/her general size (i.e. large, medium, or small, etc.), the hip-belt strap 103*a* may be passed through the marker 313, which may be affixed to the backpanel 201. Then the hip-belt strap 103*a* may be threaded through the cam buckle 311, which may also be affixed to the backpanel 201. The length of the hip-belts may then be adjusted by moving the hip-belt strap 103*a* in the horizontal direction, upon which the cam buckle 311 may be used to fasten the hip-belt strap 103*a* in place. Finally, the adjusted length of the hip-belts may be marked by the indicia of measurement 103*s* in reference to the marker 313. Thus, any further changes and readjustments can be brought back to this customized position, merely by unlocking the cam lock 312, setting the strap 103*a* into the desired position in observation of the indicia of measurement 103*s*, and then by snapping the cam lock 312 back in place.

In addition to being a user friendly solution for custom-fitting the length of the hip-belts, the efficiency aspect of the current invention ensures that accuracy is achieved even during numerous adjustments, and even when the user cannot afford to dedicate full attention to the adjustment procedure, e.g., during inclement weather hindrance, or in environment of poor visibility, etc.

Certain embodiments of the present invention avoid repetitive attaching and detaching of the entire hip-belt set and also eliminate unnecessary nuisance to users, especially in instances where there are frequent rotations among the users of the backpack. By optimizing the custom-fit of the hip-belts, certain embodiments of the present invention improve the endurance of the user, decrease the risk of injury, and simplify the hip-belt adjustment process.

Figure 4:
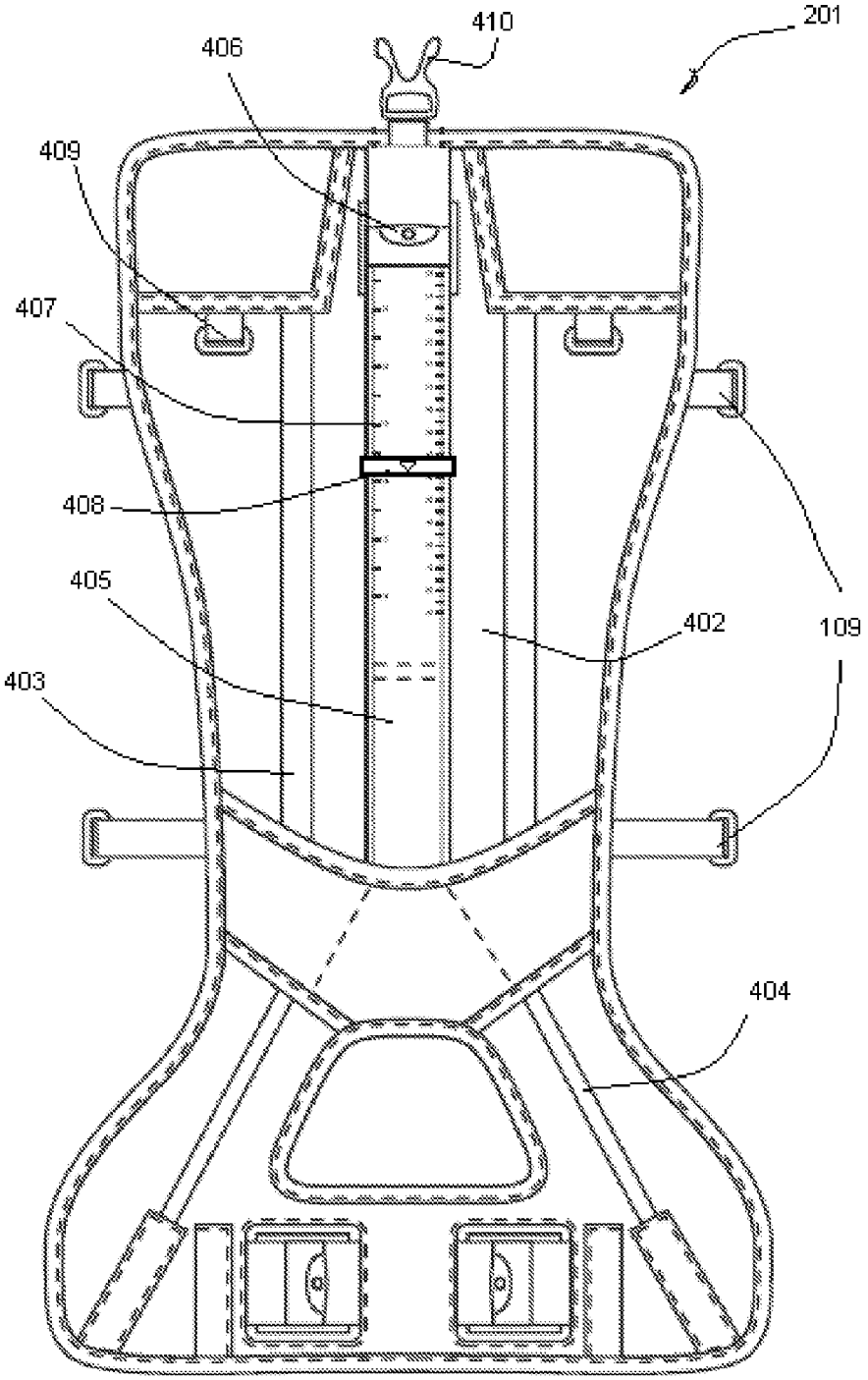
FIG. 4 shows an example of a backpanel in detail, with shoulder pads, hip-belt pads, and a lumbar pad removed, in accordance with certain embodiments of the present invention.

FIG. 4. illustrates the backpanel 201, where the load-containing portion, the shoulder strap set, the hip-belt set, and the lumbar pad are removed for clarity.

In one embodiment of the present invention, the backpanel 201 relies on panel sheet 402 and metal stays 403, where the stays 403 are further supported by tubing frame 404. Non-limiting examples of a suitable material for the panel sheet 402 include polyethylene, such as high density polyethylene (HDPE), or any other material suitable for support and carriage of numerous utility and safety elements of backpacks. The metal stays 403 and the tubing frame 404 may be constructed substantially of aluminum, or any other material considered suitable for supporting the backpanel 201. The frame 404 may be cylindrical and it may further have a solid core, preferably approximately 5.0 mm in diameter. Backpacks designed to carry heavier load may include frame 404 that is preferably hollow and 8.0 mm in external diameter for extra structure, for example.

In one embodiment, the backpanel 201 may further contain a ruler belt 405, where setting a length of the ruler belt 405 may adjust a thoracic height of the backpanel 201. Subsequent fastening of belt lock 406 may maintain the desired adjustment. Furthermore, the ruler belt 405 may include a plurality of indicia of measurement 407, which may be formed by etching, screen printing, embroidery, or any other technique deemed suitable for marking. In one embodiment, the ruler belt 405 may be constructed substantially of hypalon, or any other material considered suitable for marking. In addition, the ruler belt 405 may further include a length indicator 408, which may be affixed to the backpanel 201 and which may function as a reference for the plurality of indicia of measurement 407. Any other suitable indicia or marking may be used to indicate the various positions of the belt 405.

The backpanel 201 may further include compression straps 109, which may be used for adjusting the depth of the load-containing portion of the backpack and for securing the load. Carrying hooks 409 may attach to the shoulder straps (not shown) and may attach the shoulder straps to the backpanel 201. Finally, load securing lock 410 may be used for further fastening the contents of the backpack, and the linking mechanism used may be a snap-in hook, or any other mechanism deemed suitable for secure attachment.

While various embodiments have been described, other embodiments are plausible. It should be understood that the foregoing descriptions of various examples of a backpack with adjustable hip-belts are not intended to be limiting, and any number of modifications, combinations, and alternatives of the examples may be employed.

The examples described herein are merely illustrative, as numerous other embodiments may be implemented without departing from the spirit and scope of the present invention. Moreover, while certain features of the invention may be described above only in the context of certain examples or configurations, these features may be exchanged, added, and removed from and between the various embodiments or configurations while remaining within the scope of the invention.

We claim:

1. A backpack, comprising:

an adjustable padded shoulder-strap set, wherein the shoulder-strap set is attached to a backpanel of the backpack; and an adjustable padded hip-belt set, wherein the hip-belt set is mounted to the backpanel by a pair of hip-belt adjustment mechanisms, wherein the hip-belt set includes a pair of hip-belt straps, wherein each of the hip-belt adjustment mechanisms includes a cam buckle, a cam lock, and a buckle webbing, wherein the hip-belt adjustment mechanisms are attached to the backpanel of the backpack and receive the hip-belt straps to mount the hip-belt set to a lumbar region of the backpanel, and wherein the hip-belt set is configured to be adjusted by moving at least one of the hip-belt straps horizontally through one of the cam buckles, and then once in a desired position, fastened in place against the backpanel by moving the cam lock of the cam buckle to a closed position.

2. The backpack of claim 1, wherein at least one of the hip-belt straps includes a plurality of indicia of measurement.

3. The backpack of claim 2, wherein the backpanel includes a marker, wherein the marker functions as a reference for the plurality of indicia of measurement.

4. The backpack of claim 2, wherein the plurality of indicia of measurement are formed by stitching.

5. The backpack of claim 2, wherein the plurality of indicia of measurement are equidistant with respect to each other.

6. The backpack of claim 1 further comprising a lumbar pad, wherein the lumbar pad is attached to the backpanel.

7. The backpack of claim 6, wherein the lumbar pad is placed over the pair of hip-belt adjustment mechanisms.

8. The backpack of claim 7, wherein the lumbar pad is either fully or partially detachable from the backpanel.

9. The backpack of claim 8, wherein detaching the lumbar pad from the backpanel provides access to the pair of hip-belt adjustment mechanisms.

10. The backpack of claim 1, wherein the backpanel further comprises a ruler belt, wherein setting a length of the ruler belt adjusts a thoracic height of the backpanel.

11. The backpack of claim 10, wherein the ruler belt includes a plurality of indicia of measurement.

12. The backpack of claim 11, wherein the plurality of indicia of measurement are formed by etching.

13. The backpack of claim 11, wherein the ruler belt further includes a length indicator, wherein the length indicator is affixed to the backpanel to function as a reference for the plurality of indicia of measurement.

14. The backpack of claim 1, wherein the backpanel comprises a panel sheet, a set of stays and a thoracic carriage.

15. The backpack of claim 14, wherein the thoracic carriage moves strictly in the vertical direction.

16. The backpack of claim 14, wherein the thoracic carriage moves exclusively as one unit.

17. A method of customizing hip-belts for a backpack, comprising:

providing an adjustable padded hip-belt set, wherein the hip-belt set is mounted to a backpanel of the backpack by a pair of hip-belt adjustment mechanisms, the hip-belt set includes a pair of hip-belt straps, each of the hip-belt adjustment mechanisms includes a cam buckle, a cam lock, and a buckle webbing, and the hip-belt adjustment mechanisms are attached to the backpanel of the backpack and receive the hip-belt straps to mount the hip-belt set to a lumbar region of the backpanel;

passing each of the hip-belt straps through a marker, wherein the marker is affixed to the backpanel;

threading each of the hip-belt straps through the cam buckle, wherein the cam buckle is affixed to the backpanel;

moving at least one of the hip-belt straps in the horizontal direction through the cam buckle in order to adjust a length of the hip-belt strap;

using the cam buckle to fasten the hip-belt strap in place against the backpanel; and marking the adjusted length of the hip-belt strap by a plurality of indicia in reference to the marker.

18. The method of claim 17, further comprising removing a fully or partially detachable lumbar pad in order to access the pair of hip-belt adjustment mechanisms.

19. A backpack, comprising:

an adjustable padded shoulder-strap set, wherein the shoulder-strap set is attached to a backpanel; and an adjustable padded hip-belt set, wherein the hip-belt set is mounted to the backpanel by a pair of hip-belt adjustment mechanisms, wherein the hip-belt set includes a pair of hip-belt straps, wherein each of the hip-belt adjustment mechanisms includes a cam buckle, a cam lock, and a buckle webbing, wherein the hip-belt adjustment mechanisms are attached to the backpanel of the backpack and receive the hip-belt straps to mount the hip-belt set to a lumbar region of the backpanel, wherein the hip-belt set is configured to be adjusted by moving at least one of the hip-belt straps horizontally through one of the cam buckles, and then once in a desired position, fastened in place against the backpanel by moving the cam lock of the cam buckle to a closed position, and wherein a marker is affixed to the backpanel to function as a reference for a plurality of indicia of measurement included on at least one of the hip-belt straps.

* * * * *